United States Patent [19]

Bailey et al.

[11] Patent Number: 4,660,863

[45] Date of Patent: Apr. 28, 1987

[54] CASING PATCH SEAL

[75] Inventors: Thomas F. Bailey; Nehal M. Shah, both of Houston, Tex.

[73] Assignee: A-Z International Tool Company, Houston, Tex.

[21] Appl. No.: 758,370

[22] Filed: Jul. 24, 1985

[51] Int. Cl.[4] ..... F16L 25/00

[52] U.S. Cl. ..... 285/145; 285/910; 285/397; 277/236; 166/207; 294/86.32; 294/86.3

[58] Field of Search ..... 285/18, 397, 319, 422, 285/145, 910; 277/236; 166/207, 217; 294/86.32, 86.3, 86.31

[56] References Cited

U.S. PATENT DOCUMENTS

| | | | |
|---|---|---|---|
| 2,098,332 | 11/1937 | Church | 294/86.31 |
| 2,119,797 | 6/1938 | Siracosa | 294/86.3 |
| 2,864,450 | 12/1958 | Burns | 294/86.3 |
| 3,216,503 | 11/1965 | Fisher et al. | 285/145 X |
| 3,292,938 | 12/1966 | Tamplen | 277/116.2 |
| 3,330,341 | 7/1967 | Jackson et al. | 285/319 X |
| 3,330,357 | 7/1967 | Elliston | 166/134 |
| 3,342,268 | 9/1967 | Brown | 166/124 |
| 3,420,307 | 1/1969 | Conrad | 164/134 |
| 3,422,673 | 1/1969 | Lebourg | 73/152 |
| 3,472,520 | 10/1969 | Burns | 277/116.2 |
| 3,701,382 | 10/1972 | Williams | 166/183 |
| 4,023,847 | 5/1977 | Webb | 294/86.3 |
| 4,127,168 | 11/1978 | Hanson et al. | 166/123 |
| 4,161,319 | 7/1979 | Stocking | 277/116.6 |
| 4,258,926 | 3/1981 | Upton | 277/116.4 |
| 4,296,806 | 10/1981 | Taylor et al. | 166/120 |
| 4,344,651 | 8/1982 | Longacre et al. | 299/5 |
| 4,396,066 | 8/1983 | Akkerman et al. | 285/145 X |
| 4,403,660 | 9/1983 | coone | 166/387 |
| 4,452,463 | 6/1984 | Buckner | 277/120 |
| 4,484,625 | 11/1984 | Barbee, Jr. | 166/185 |
| 4,548,265 | 10/1985 | Luke | 285/376 X |

*Primary Examiner*—Richard J. Scanlan, Jr.
*Assistant Examiner*—Joseph A. Fischetti
*Attorney, Agent, or Firm*—Edgar A. Zarins; Malcolm L. Sutherland

[57] ABSTRACT

A casing patch for providing a connection between two casing sections which comprise a body means adapted to fit over an existing casing in a well bore and guide the patch into place, a slip means actuated by upward movement of the second casing section to tightly connect the two casing sections, and a seal means also actuated by upward movement of the second casing section for sealing the connection to pressure of fluids, under conditions of high pressure and temperature. The seal comprises a lead ring inside the casing patch surrounding the existing casing and a cylindrical seal arranged below the lead ring and having a central section of a deformable material and two end sections of wire mesh.

15 Claims, 5 Drawing Figures

CASING PATCH SEAL

TECHNICAL FIELD

The present invention relates to an apparatus for connecting and sealing a new section of casing to an old casing in an oil and gas well. More particularly, the invention discloses a casing patch used to connect two sections of casing and seal the two sections under high temperature and pressure conditions.

DISCLOSURE OF THE INVENTION

A casing patch is used to connect and seal two strings of casing, typically of the same diameter in a well, e.g. an oil or gas well. Over a period of time, due to adverse well conditions, etc., a well casing may erode and become damaged beyond use. In many instances it is possible to remove the upper portion of the damaged casing using a conventional casing cutter tool and by means of a casing patch connect a new section of casing to the old casing. In other instances, a casing may stick when going into the well and it then becomes necessary to remove the upper portion of the stuck casing and reconnect a new casing section by means of a casing patch in order to continue normal operations. Further, a casing may be sealed and later it may be desired to reopen the well. This may be done by cutting the casing below the seal and attaching a new section of casing. In each instance, it is necessary that the new casing be tightly connected to the top of the old casing and this is the function of a casing patch.

The casing patch of the present invention is designed to provide a tight seal and connection between two casing sections. The casing patch may be used under a wide range of adverse well conditions, e.g. high temperature and high pressure. In general, the casing patch of this invention comprises a body means adapted to fit over the old casing and guide the patch into place, a slip means actuated by upward movement of the body means for tightly connecting the two casing sections and a seal means actuated upward by the body means for sealing the connection to pressure loss of fluids at the patch, even under conditions of high pressure and temperature. A casing extension connects the new section of casing to the old section. The new section of casing is used to position the casing patch and install it. The slip means includes a collapsible slip and slip bowl which function to grip the existing casing upon movement relative to each other by tension applied through the new casing. Body slips, upon actuation of the casing patch, tightly grip the body of the casing patch to bind the new casing section to the old casing section and prevent release of the connection between the two casing sections, e.g. upon release of the tension applied by the drill string.

The seal means of the present invention is actuated by tension on the new casing section to provide a high pressure, high temperature seal and prevent leakage at the patch. The seal means includes a lead ring inside the casing patch around the old casing and at least one cylindrical seal having a central section of a deformable material and two end sections of wire mesh. In one embodiment the lead ring and the deformable material can be the same element; however, in the preferred embodiment, the deformable material is rubber and the lead ring is a separate element, positioned above the cylindrical seal. In a further embodiment, a cylindrical seal is provided both above and below the lead ring.

Upon actuation of the seal means to compress the two end sections of wire mesh, the wire mesh sections first compress to form a pocket containing the deformable material, then act to compress the deformable material and provide a tight seal between the casing patch and old casing. Continued tension on the new casing section causes compression of the lead ring to provide a tight and primary seal between the interior of the casing patch and the extension of the old casing section. The wire mesh used in the seal has a mass sufficient to provide a solid metal seal between the interior of the casing patch and the outer wall surface of the old casing upon compression of the mesh during actuation of the casing patch. The wire mesh preferably is made of stainless steel or other corrosion resistant metal. Also, the deformable material is made of a material resistant to well fluids and high temperatures and pressures, such as fluorocarbon rubber, and which has an elongation sufficient to permit the rubber to flow without shearing or breaking under well pressure, e.g. an elongation of above about 100%, preferably above about 150%. Viton 90 Duro, 150% elongation is an example of a rubber. The wire mesh and deformable material preferably are joined together in their manufacture, e.g. by adhesive or pressure, so that they can be installed together as one element.

Lead has been used heretofore to provide seals in casing patches and is a preferred sealing material because of its inertness to fluids normally found in wells. Lead will cold form under pressure to the shape required to provide a seal and is particularly useful where the old casing has a rough surface. However, because it may be cold formed even at room temperature, under conditions of high temperature and pressure, lead will flow and seals entirely of lead lose their effectiveness. In the present invention, upon actuation of the casing patch through tension applied by the new casing, the seal formed by the collapsed wire mesh sections and the deformable material prevent the lead from flowing in the longitudinal direction of the casing and permit the use of lead as the primary seal, even under high temperature and pressure.

BRIEF DESCRIPTION OF THE DRAWINGS

This invention will be apparent from a consideration of the detailed specification, including the attached drawings. In the drawings.

DESCRIPTION OF THE PREFERRED EMBODIMENTS

Figure 1A:
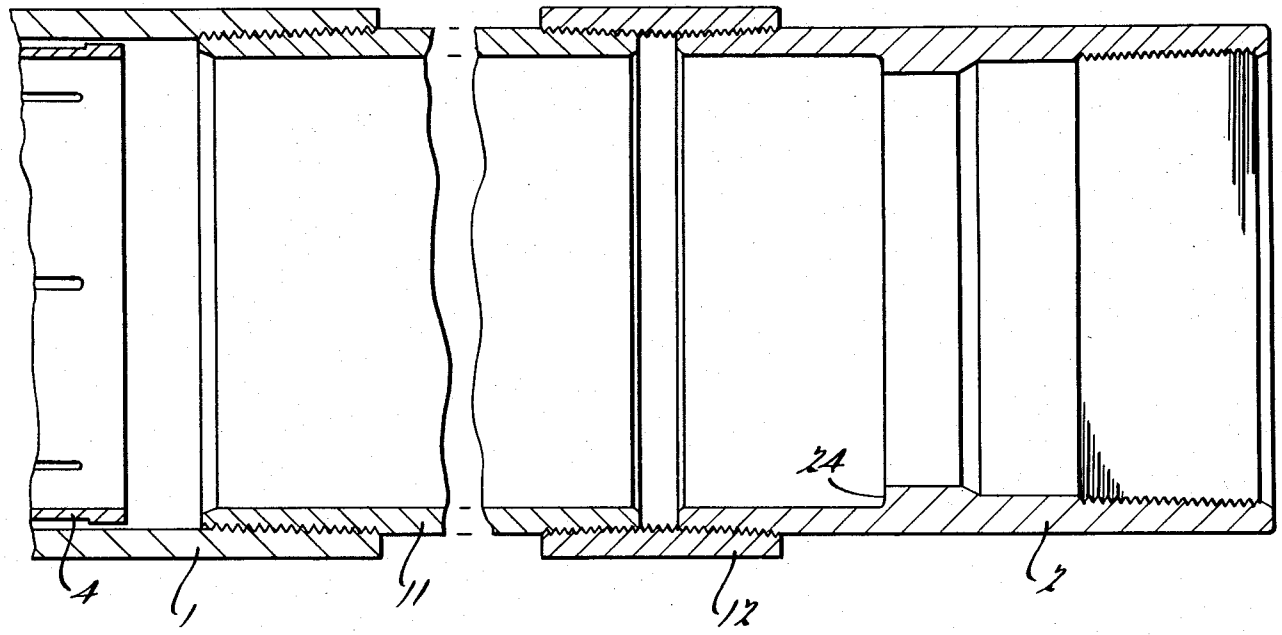
FIGS. 1*a* and 1*b* are a cross-sectional view of the casing patch of the present invention.

In the casing patch of this invention, as shown in the drawings, details of the new casing section have been omitted since the drawings are primarily to illustrate the novel features of the casing patch of this invention and the method by which it is set.

The casing patch as shown in FIGS. 1*a* and 1*b* comprises a body means including casing extension 11 connected by coupling 12 to a top sub 2 which is adapted to be connected, e.g. by threads, as shown, to a new casing section, a body member 1 and lower guide means 3. In use, the casing patch will be lowered and raised by the new casing section in a conventional manner to position the casing patch and to apply tension to actuate the casing patch. The lower guide member 3 is adapted to fit over the upper portion of an existing casing 20 in a well. Two packing rings 10, e.g. conventional "polypacs" retained within grooves in the wall of lower guide 3 provide a lower seal between casing 20 and lower guide 3. Additional packing rings may be used, if desired, so long as the friction applied by these rings permits the casing patch to slide over casing 20.

Figure 4:
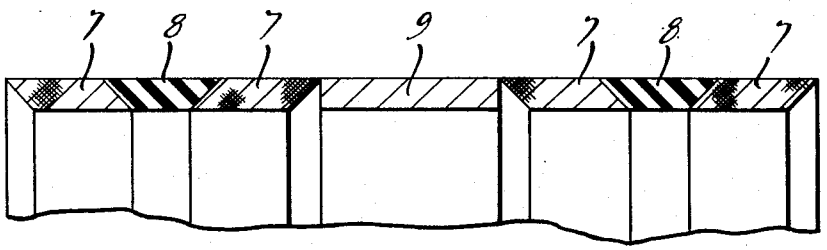
FIG. 4 is a view, partly in section, of one embodiment of the high pressure seal of the present invention.
Figure 1:
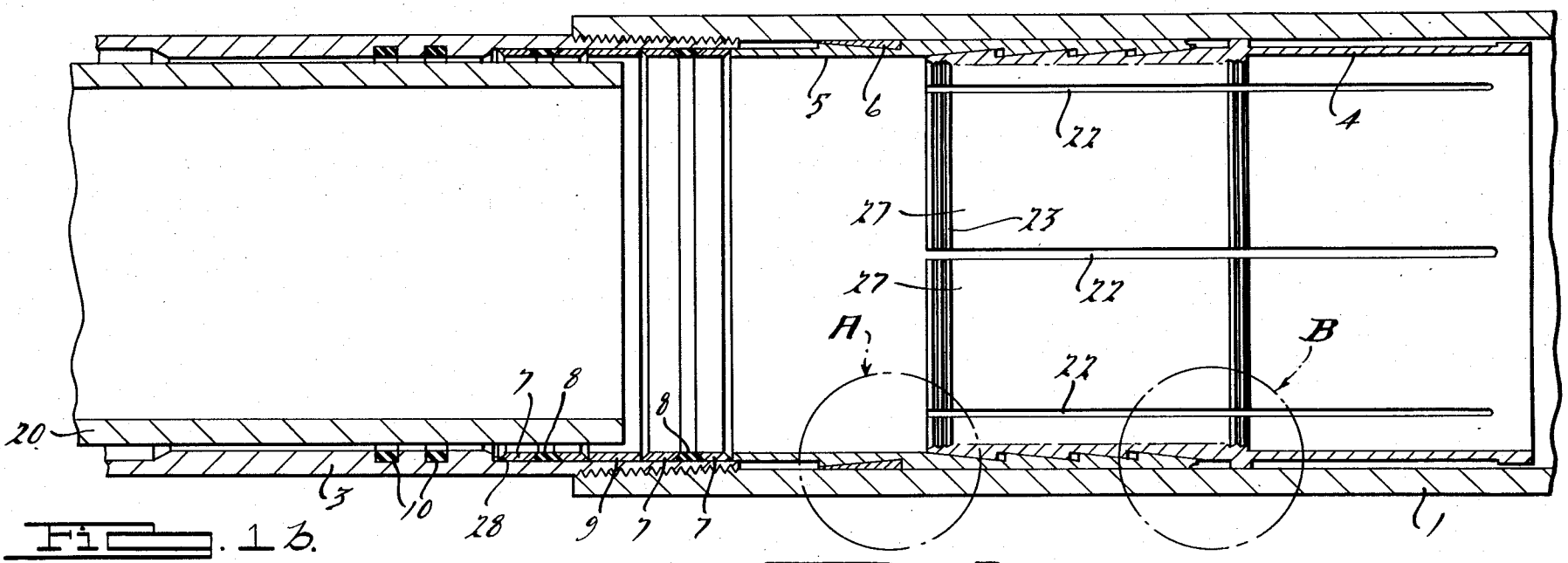

The high pressure seal of the present invention, as shown in FIG. 4, comprises a compressible ring formed by wire mesh elements 7 on either side of a deformable pack-off element 8 which may be rubber or lead or other compressible material, arranged below a lead ring 9. A second compressible ring may be used above lead ring 9, as shown. The seal including lead ring 9 and wire mesh elements 7 and pack-off 8 are retained within a machined section of the lower guide 3 including shoulder 28 to permit the casing patch to slide over casing 20.

Within body member 1 is the connecting means by which the upper portion of casing 20 is secured to the new casing, e.g. through casing extension 11, and the seal means of this invention. This connecting means comprises slip 4, slip bowl 5 and body slips 6. As designed, slip 4 is telescopingly received within slip bowl 5. Slip 4 and slip bowl 5 have mating stepped, tapered ramps, i.e. ratchets 14 and 15, on their outer and inner surfaces, respectively, that prevent movement in the reverse direction. Upon assembly of the connecting means prior to installation, each of the ratchets 14 mate with a corresponding ratchet 15 as shown in FIG. 16. However, once the old casing 20 is fully seated, movement will only be along the cooperating surfaces of each ramp since the casing 20 will prevent the ratchet 14 from overtaking the next ratchet 15. Slip 4 has a series of slots 22, e.g. six, cut longitudinally thereof and spaced around the circumference to form fingers 27 so that the lower end of slip 4 can be compressed to grip casing 20. Threads or serrations 23 are provided on the interior surface of slip 4 to assist in gripping casing 20. The slip 4 has an inner diameter which closely corresponds to, but is slightly greater than, the outer diameter of the casing 20. Thus, the combination of the serrations 23 and the closely conforming diameters creates a frictional engagement which facilitates setting of the casing patch as will be subsequently described. A shoulder 26 on the outer surface of slip 4 limits the upward movement of slip bowl 5 relative to slip 4. The end of casing extension 11 also limits upward movement of slip 4 within the casing patch.

Figure 2:
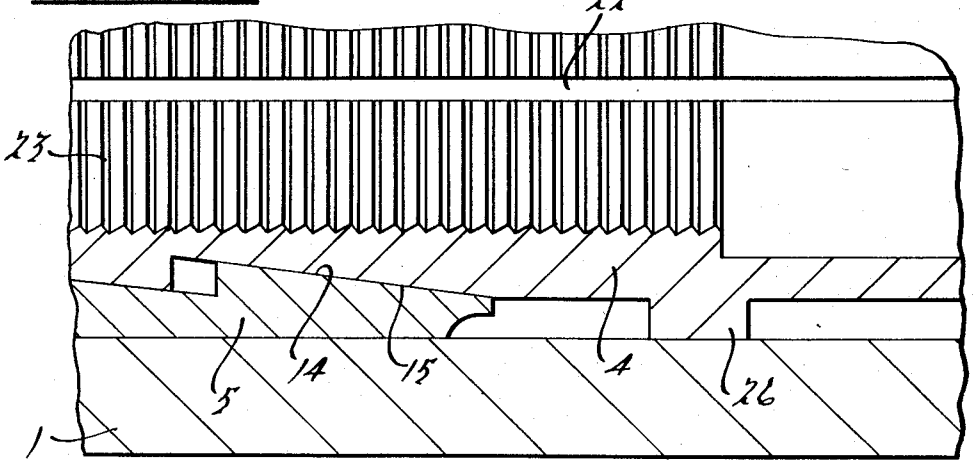
FIG. 2 is an enlarged view of the portion of the casing patch of FIG. 1 within circle A.
Figure 3:
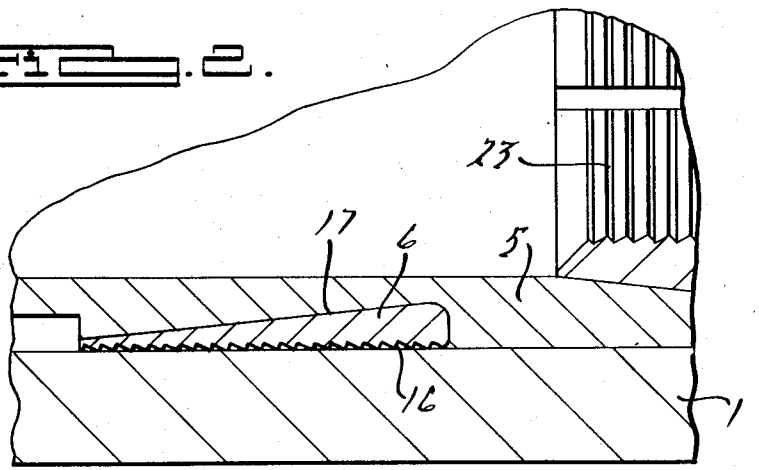
FIG. 3 is an enlarged view of the cross-sectional view of FIG. 1 within circle B.

Body slips 6 comprise a plurality of wedge-shaped elements, e.g. twelve, each one of which is fitted in a wedge-shaped groove 17 on the outer diameter of slip bowl 5. The body slips, as shown by FIG. 2, have serrations 16 on the surface bearing against the inner diameter of body 1 to provide additional grip.

In use, prior to running the casing patch, the well hole and casing are prepared by cutting the old casing and dressing the casing with a standard dressing tool, e.g. smoothing the exterior of the casing for a length sufficient to accommodate the casing patch, usually a length of several feet, e.g. six feet. The casing patch is then run into the well on a new section of casing until the patch contacts the prepared old casing 20. The patch is then lowered until the casing 20 rests against abutment 24 in top sub 2. The casing 20 will frictionally engage the inner diameter of slip 4 possibly causing slip 4 to move upwardly until the end of casing extension 11 is engaged. However, this frictional engagement is readily overcome to provide full engagement of the casing patch with the old casing 20. Sufficient weight, e.g. 15,000 to 20,000 pounds, is applied to the casing patch by the new casing section to overcome the frictional contact between slip 4 and casing 20 and insure that the casing patch is fully seated on casing 20. Thereupon, the operator picks up on the new casing section and exerts an upward force sufficient to set the slip means, e.g. 15,000 to 20,000 pounds. This force pulls lower guide 3 upward. Shoulder 28 abuts the seal means and continued upward movement moves the seal means and slip bowl 5. As slip bowl 5 moves, the frictional engagement between slip 4 and the casing 20 will deter the slip 4 from moving with slip bowl 5 thereby causing the serrations 23 to bind on casing 20 and increasing the frictional engagement. Continued upward force will cause slip bowl 5 to further move upward relative to slip 4 and the ramped surfaces of ratchets 14 and 15 move along each other thereby decreasing the inner diameter of the slip 4. As further tension is applied through the new casing section, the ramped surfaces 14 and 15 continue to move in opposite directions to collapse fingers 27 of slip 4 and squeeze these fingers against casing 20 to grip the old casing section. Additional upward force is applied to slip 4 such that it firmly grips the casing and also energizes the seal means. Shoulder 26 is provided on body 1 to prevent slip 4 from biting into casing 20 too much. Shoulder 26 permits slip bowl 5 to move a predetermined distance to that the finger elements 27 forming the lower end of slip 4 can engage against the casing while preventing the ratchets 14 and 15 from moving over the stepped edge to the next ratchet. If slip body 5 continued to rise, fingers 27 would continue to collapse and eventually puncture or collapse casing 20.

The seal means is energized by continued upward tension applied by the new casing section which, upon setting of the slip means, i.e., abutment of slip bowl 5 against shoulder 26, causes wire mesh elements 7 and the deformable element 8 to be compressed. Sufficient force, e.g. about 50,000 pounds, is applied to collapse the wire mesh and form a metal-to-metal seal against casing 20 at each wire mesh element 7 and a pocket between the two wire mesh elements 7 which contains deformable element 8 and causes element 8 also to seal against casing 20. This force also causes lead ring 9 to flow or deform and create the primary seal. Thereby, a strong seal is provided between the casing patch elements, body 1, lower guide 3, and slip bowl 5 and the top of old casing 20. Body slips 6 through their wedge shape and the serrations 16 on their outer surfaces, which ride against body 1, prevent the slip bowl 5 from sliding downward within body 1. Further, the surfaces 14 and 15 prevent slip 4 and slip bowl 5 from moving relative to each other.

Once the casing patch has been engaged and the seals energized as described, the casing patch can be pressure tested to verify the seals. In operation, the interior of the casing is under pressure and referred to as the high pressure side of the seal. This pressure is applied against the upper surface of slip bowl 5, around slip 4, and against the seal, around slip bowl 5. Body slips 6 prevent downward movement of slip bowl 5. Furthermore, in operation, the casing will carry high temperature fluids and, accordingly, expand over time. Since the casing is locked down at the well bowl, this expansion causes a downward force on the casing patch body. At the same time, the slip 4 and slip bowl 5, which are essentially one piece with the casing after actuation, are forced upward by the internal pressure. Further, the expansion of the old casing tends to elongate this casing. These forces in sum try to separate the slip bowl and the seal means. Any movement between the slip bowl 5 and lead ring 9 can, however, deenergize the seal because such separation removes the tension used to actuate the seal and provides a place for the lead ring to flow. Movements of one quarter inch can deenergize the seal. Slip bodies 6 prevent this separation and thereby keep sufficient of the tension applied during actuation on the seal means on the seal to keep it energized, e.g. to prevent a loss of greater than 20%, preferably 10% of this force. The pressure applied by the seal because of the forces applied through this tension must always be greater than the pressure applied at the seal by well fluids. The seal provided by the deformable material and collapsed wire mesh also function to prevent lead ring 9 from flowing in between the casing 20 and body 1 or guide body 3.

While there are described above the principles of this invention in connection with specific apparatus, it is to be clearly understood that this description is made only by way of example and not as a limitation to the scope of the invention:

I claim:

1. A casing patch adapted to be run in a well bore for connecting a first casing section attached to the casing patch to a second casing section in the well and providing a tight seal of the connection upon the application of tension by the first casing section in an upward direction, comprising:

body means having an inner surface adapted to fit over the outer surface of said second casing section, slip means within the body means adapted to fit over said outer surface of the second casing section for tightly connecting the first and second casing sections upon application of tension on the first casing section, seal means within said body means adapted to fit over said outer surface of the second casing section actuated by said tension on said first casing section for sealing the connection between said first and second casing sections, said slip means comprising an annular slip and an annular slip bowl, said slip telescoping within said slip bowl upon relative movement between said slip and said slip bowl, and means for radially contracting the end of said slip to tightly grip said outer surface of the second casing section upon relative movement between said slip and said slip bowl, said seal means comprising a lead ring and a compressible ring means formed of a first annular wire mesh ring, a second annular wire mesh ring and a ring of deformable material between said first and second wire mesh rings, said seal means being arranged within said body means with said compressible ring means below said lead ring, said seal means surrounding said second casing section so that upon application of said tension by the first casing section said body means compresses said first and second wire mesh rings to form a metal seal between said inner surface of the body means and said outer surface of the second casing section to define therebetween a sealed pocket wherein said deformable material is contained and, upon continued application of said tension said lead ring flows to form a seal between said inner surface and said outer surface and said deformable material is compressed to form a seal between said outer surface of the second casing section and said inner surface of the body means to prevent flow of said lead ring downward between said inner and outer surfaces, and means for limiting upward movement of said slip bowl relative to said slip.

2. The casing patch as defined in claim 1 further including means for preventing separation of said slip bowl relative to said seal means to maintain tension of said seal means.

3. The casing patch as defined in claim 2 wherein said body means defines a chamber containing said slip, said slip bowl and said seal means, said chamber having a lower abutment surface which abuts said seal means when said tension is applied by the first casing section to move said slip bowl relative to said slip and cause said slip to grip said outer surface of the second casing section and to compress said seal means.

4. The casing patch as defined in claim 3 wherein said means for radially contracting the end of the slip includes a series of longitudinal slots in said slip which define at said end thereof a plurality of fingers, and means for bending said fingers upon telescoping movement of the slip and slip bowl so that said fingers tightly grip said outer surface of the second casing section.

5. The casing patch as defined in claim 4 wherein said slip and said slip bowl are annular in shape and have inner and outer annular mating surfaces adapted to slide over each other which form said means for bending said fingers, said mating surfaces bending said fingers and preventing movement between the slip and slip bowl upon release of the tension applied to the drill string.

6. The casing patch as defined in claim 5 wherein said means for preventing separation between said slip bowl and seal means comprises at least one groove in the outer annular surface of said slip and wedge-shaped body slip means contained within said groove for preventing downward movement of said slip bowl relative to said body means.

7. The casing patch as defined in claim 5 wherein the deformable material is lead.

8. The casing patch as defined in claim 5 wherein the deformable material is rubber.

9. The casing patch as defined in claim 2 wherein said limiting means includes shoulder means formed on the outer annular surface of said slip for limiting upward movement of said slip bowl relative thereto and thereby limiting the gripping force of said slip to prevent collapse of said second casing section upon radial contraction of said end of said slip.

10. The casing patch as defined in claim 2 wherein said seal means includes a second compressible ring means arranged above said lead ring.

11. A casing patch adapted to be run in a well bore for connecting a first casing section attached to the casing patch to a second casing section in the well and providing a tight seal at the connection upon the application of tension by the first casing section in an upward direction, comprising:

body means having an inner surface adapted to fit over the outer surface of said second casing section;

slip means within the body means adapted to fit over said outer surface of the second casing section for tightly connecting the first and second casing sections upon application of tension on the first casing section;

said slip means comprising an annular slip and an annular slip bowl, said slip telescoping within said slip bowl upon relative movement between said slip and said slip bowl, and means for radially contracting the end of said slip to tightly grip said outer surface of the second casing section upon relative movement between said slip and said slip bowl; and resilient seal means within said body means adapted to fit over said outer surface of the second casing section actuated by said tension on said first casing section for sealing the connection between said first and second casing sections;

said seal means comprising a lead ring, a first compressible ring means formed of a first annular wire mesh ring, a second annular wire mesh ring and a ring of deformable material between said first and second wire mesh rings, and a second compressible ring means formed of a first annular wire mesh ring, a second annular wire mesh ring and a ring of deformable material between said first and second wire mesh rings, said seal means being arranged within said body means with said lead ring disposed between said first and second compressible ring means so that upon application of said tension by the first casing section said body means compresses said wire mesh rings to form a metal seal between said body means and the second casing section.

12. The casing patch as defined in claim 11 and further comprising means for preventing separation of said slip bowl relative to said seal means to maintain tension of said seal means.

13. A casing patch adapted to be run in a well bore for connecting a first casing section attached to the casing patch to a second casing section in the well and providing a tight seal of the connection upon the application of tension by the first casing section in an upward direction, comprising:

body means having an inner surface adapted to fit over the outer surface of said second casing section;

slip means within the body means adapted to fit over said outer surface of the second casing section for tightly connecting the first and second casing sections upon application of tension on the first casing section;

said slip means comprising an annular slip and an annular slip bowl, said slip telescoping within said slip bowl upon relative movement between said slip and said slip bowl, and means for radially contracting the end of said slip to tightly grip said outer surface of the second casing section upon relative movement between said slip and said slip bowl;

resilient seal means within said body means adapted to fit over said outer surface of the second casing section actuated by said tension on said first casing section for sealing the connection between said first and second casing sections;

said seal means comprising a lead ring and a compressible ring means formed of a first annular wire mesh ring, a second annular wire mesh ring and a ring of deformable material between said first and second wire mesh rings, said seal means being arranged within said body means so that upon application of said tension by the first casing section said body means compresses said first and second wire mesh rings to form a metal seal between said body means and the second casing section; and means for preventing separation of said slip bowl relative to said seal means to maintain tension of said seal means.

14. The casing patch as defined in claim 13 wherein said means for preventing separation between said slip bowl and seal means comprises at least one groove in the outer annular surface of said slip and wedge-shaped body slip means contained within said groove for preventing downward movement of said slip body relative to said bowl means.

15. The casing patch as defined in claim 13 and further comprising means for limiting upward movement of said slip bowl relative to said slip including shoulder means formed on the outer annular surface of said slip, said means limiting the gripping force of said slip to prevent collapse of said second casing section upon radial contraction of said end of said slip.

* * * * *